US009293143B2

(12) United States Patent
Villette et al.

(10) Patent No.: US 9,293,143 B2
(45) Date of Patent: Mar. 22, 2016

(54) BANDWIDTH EXTENSION MODE SELECTION

(71) Applicant: QUALCOMM Incorporated, San Diego, CA (US)

(72) Inventors: Stephane Pierre Villette, San Diego, CA (US); Daniel J. Sinder, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/270,963

(22) Filed: May 6, 2014

(65) Prior Publication Data

US 2015/0162008 A1 Jun. 11, 2015

Related U.S. Application Data

(60) Provisional application No. 61/914,845, filed on Dec. 11, 2013.

(51) Int. Cl.

| | |
|---|---|
| ***G10L 19/00*** | (2013.01) |
| ***G10L 19/008*** | (2013.01) |
| ***G10L 19/24*** | (2013.01) |
| ***G10L 19/005*** | (2013.01) |
| ***G10L 21/038*** | (2013.01) |

(52) U.S. Cl.

CPC ..... *G10L 19/00* (2013.01); *G10L 19/005* (2013.01); *G10L 19/008* (2013.01); *G10L 19/24* (2013.01); *G10L 21/038* (2013.01)

(58) Field of Classification Search

CPC combination set(s) only.

See application file for complete search history.

(56) References Cited

U.S. PATENT DOCUMENTS

| | | | |
|---|---|---|---|
| 6,205,130 | B1 | 3/2001 | DeJaco |
| 8,032,369 | B2 | 10/2011 | Manjunath et al. |
| 8,630,685 | B2 | 1/2014 | Schrage |
| 8,880,404 | B2 | 11/2014 | Villett et al. |
| 2007/0282603 | A1 | 12/2007 | Bessette |
| 2010/0228557 | A1 | 9/2010 | Chen et al. |
| 2011/0202353 | A1 | 8/2011 | Neuendorf et al. |
| 2012/0203556 | A1 | 8/2012 | Villette et al. |
| 2012/0203561 | A1 | 8/2012 | Villette et al. |
| 2013/0317811 | A1 | 11/2013 | Grancharov et al. |

OTHER PUBLICATIONS

Fingscheidt T., et al., "Softbit Speech Decoding: A New Approachto Error Concealment", IEEE Transactions on Speech and Audio Processing, IEEE Service Center, New York, NY, US, vol. 9, No. 3, Mar. 1, 2001, pp. 1-12, XP011054083, ISSN: 1063-6676.

Geiser B., et al., "A Qualified ITU-T G.729EV Codec Candidate for Hierarchical Speech and Audio Coding," Multimedia Signal Processing, 2006 IEEE 8th Workshop on, vol., no., pp. 114-118, Oct. 3-6, 2006.

International Search Report and Written Opinion—PCT/US2014/068908—ISA/EPO—May 27, 2015.

*Primary Examiner* — Vu B Hang

(74) *Attorney, Agent, or Firm* — Toler Law Group, PC

(57) ABSTRACT

A device includes a decoder that includes an extractor, a predictor, a selector, and a switch. The extractor is configured to extract a first plurality of parameters from a received input signal. The input signal corresponds to an encoded audio signal. The predictor is configured to perform blind bandwidth extension by generating a second plurality of parameters independent of high band information in the input signal. The second plurality of parameters corresponds to a high band portion of the encoded audio signal. The selector is configured to select a particular mode from multiple high band modes including a first mode using the first plurality of parameters and a second mode using the second plurality of parameters. The switch is configured to output the first plurality of parameters or the second plurality of parameters based on the selected particular mode.

30 Claims, 7 Drawing Sheets

BANDWIDTH EXTENSION MODE SELECTION

I. CLAIM OF PRIORITY

The present application claims priority from U.S. Provisional Application No. 61/914,845, filed Dec. 11, 2013, which is entitled "BANDWIDTH EXTENSION MODE SELECTION," the content of which is incorporated by reference in its entirety.

II. FIELD

The present disclosure is generally related to bandwidth extension.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. If speech is transmitted by sampling and digitizing, a data rate on the order of sixty-four kilobits per second (kbps) may be used to achieve a speech quality of an analog telephone. Compression techniques may be used to reduce the amount of information that is sent over a channel while maintaining a perceived quality of reconstructed speech. Through the use of speech analysis, followed by coding, transmission, and re-synthesis at a receiver, a significant reduction in the data rate may be achieved.

Devices for compressing speech may find use in many fields of telecommunications. An exemplary field is wireless communications. The field of wireless communications has many applications including, e.g., cordless telephones, paging, wireless local loops, wireless telephony such as cellular and personal communication service (PCS) telephone systems, mobile Internet Protocol (IP) telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and WCDMA, which provide more capacity and high speed packet data services. Two variations of cdma2000 are presented by the documents IS-2000 (cdma2000 1×RTT) and IS-856 (cdma2000 1×EV-DO), which are issued by TIA. The cdma2000 1×RTT communication system offers a peak data rate of 153 kbps whereas the cdma2000 1×EV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets a peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, a frame length may be twenty milliseconds, which corresponds to 160 samples at a sampling rate of eight kilohertz (kHz), although any frame length or sampling rate deemed suitable for a particular application may be used.

The encoder analyzes the incoming speech frame to extract certain relevant parameters and then quantizes the parameters into a binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits $N_i$ and a data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use the amount of bits needed to encode the parameters to a level adequate to obtain a target quality.

Time-domain coders such as the CELP coder may rely upon a high number of bits, $N_0$, per frame to preserve the accuracy of the time-domain speech waveform. Such coders may deliver excellent voice quality provided that the number of bits, $N_o$, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of such parametric coders is the LP vocoder.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these hybrid coders is the prototype-waveform interpolation (PWI) speech coding system. The PWI speech coding system may also be known as a prototype pitch period (PPP) speech coder. A PWI speech coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low band"). For example, the low band may be represented using filter parameters and/or a low band excitation signal. However, in order to improve coding efficiency, the higher frequency portion of the signal (e.g., 7 kHz to 16 kHz, also called the "high band") may not be fully encoded and transmitted. A receiving device may utilize signal modeling to predict the high band. In some implementations, properties of the low band signal may be used to generate high band parameters (e.g., gain information, line spectral frequencies (LSFs, also referred to as line spectral pairs (LSPs)) to assist in the prediction. However, energy disparities between the low band and the high band may result in predicted high band parameters that inaccurately characterize the high band.

In other implementations, high band parameter information may be transmitted with the low band. The high band parameters may be extracted from the high band parameter information. In these implementations, the high band parameters may not be generated when the high band parameter information is not received, resulting in a transition from high band to low band. For example, high band parameters may be received for a particular audio signal and may not be received for a subsequent audio signal. High band audio associated with the particular input signal may be generated and high band audio associated with the subsequent audio signal may not be generated. There may be a transition from a particular output signal including the high band audio associated with the particular audio signal to a subsequent output signal associated with the subsequent audio signal. The subsequent output signal may include the low band associated with the subsequent audio signal and may not include the high band associated with the subsequent audio signal. There may be a perceptible drop in audio quality associated with the transition from the particular output signal including the high band audio to the subsequent output signal not including high band audio.

IV. SUMMARY

Systems and methods for dynamic selection of bandwidth extension techniques are disclosed. An audio decoder may receive encoded audio signals. Some of the encoded audio signals may include high band parameters that may assist in reconstructing the high band. Other encoded audio signals may not include the high band parameters or there may be transmission errors associated with the high band parameters. In a particular embodiment, the audio decoder may reconstruct the high band using the received high band parameters when the high band parameters are successfully received. When the high band parameters are not received successfully by the audio decoder, the audio decoder may generate high band parameters by performing predictions based on the low band and may use the predicted high band parameters to reconstruct the high band. In an alternative embodiment, the audio decoder may dynamically switch between using the received high band parameters and the using the predicted high band parameters based on a control input.

In a particular embodiment, a device includes a decoder. The decoder includes an extractor, a predictor, a selector, and a switch. The extractor is configured to extract a first plurality of parameters from a received input signal. The input signal corresponds to an encoded audio signal. The predictor is configured to perform blind bandwidth extension by generating a second plurality of parameters independent of high band information in the input signal. The second plurality of parameters corresponds to a high band portion of the encoded audio signal. The second plurality of parameters is generated based on low band parameter information corresponding to low band parameters in the input signal. The low band parameters are associated with a low band portion of the encoded audio signal. The selector is configured to select a particular mode from multiple high band modes for reproduction of the high band portion of the encoded audio signal. The multiple high band modes include a first mode using the first plurality of parameters and a second mode using the second plurality of parameters. The switch is configured to output the first plurality of parameters or the second plurality of parameters based on the selected mode.

In another particular embodiment, a method includes extracting, at a decoder, a first plurality of parameters from a received input signal. The input signal corresponds to an encoded audio signal. The method also includes performing, at the decoder, blind bandwidth extension by generating a second plurality of parameters independent of high band information in the input signal. The second plurality of parameters corresponds to a high band portion of the encoded audio signal. The second plurality of parameters is generated based on low band parameter information corresponding to low band parameters in the input signal. The low band parameters are associated with a low band portion of the encoded audio signal. The method further includes selecting, at the decoder, a particular mode from multiple high band modes for reproduction of the high band portion of the encoded audio signal. The multiple high band modes include a first mode using the first plurality of parameters and a second mode using the second plurality of parameters. The method further includes sending the first plurality of parameters or the second plurality of parameters to an output generator of the decoder in response to selection of the particular mode.

In another particular embodiment, a computer-readable storage device stores instructions that, when executed by a processor, cause the processor to perform operations. The operations include extracting a first plurality of parameters from a received input signal. The input signal corresponds to an encoded audio signal. The operations also include performing blind bandwidth extension by generating a second plurality of parameters independent of high band information in the input signal. The second plurality of parameters corresponds to a high band portion of the encoded audio signal. The second plurality of parameters is generated based on low band parameter information corresponding to low band parameters in the input signal. The low band parameters are associated with a low band portion of the encoded audio signal. The operations further include selecting a particular mode from multiple high band modes for reproduction of the high band portion of the encoded audio signal. The multiple high band modes include a first mode using the first plurality of parameters and a second mode using the second plurality of parameters. The operations also include outputting the first plurality of parameters or the second plurality of parameters based on the selected mode.

Particular advantages provided by at least one of the disclosed embodiments include dynamically switching between using extracted high band parameters and using predicted high band parameters. For example, the audio decoder may conceal, or reduce the effect of, errors associated with the extracted high band parameters by using the predicted high band parameters. To illustrate, network conditions may deteriorate during audio transmission, resulting in errors associated with the extracted high band parameters. The audio decoder may switch to using the predicted high band parameters to reduce the effects of the network transmission errors. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
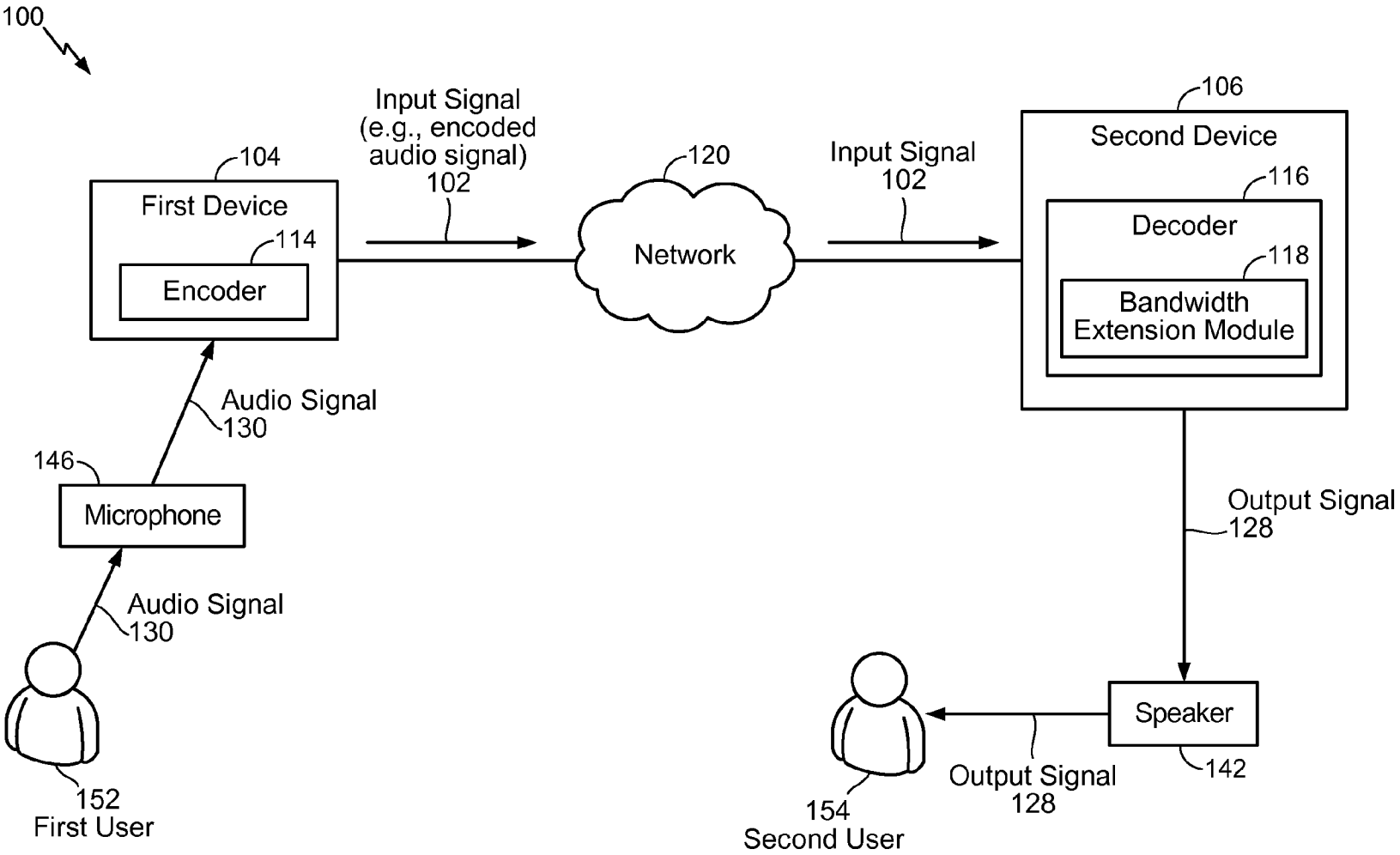
FIG. 1 is a diagram to illustrate a particular embodiment of a system that is operable to perform bandwidth extension mode selection.

The principles described herein may be applied, for example, to a headset, a handset, or other audio device that is configured to perform speech signal replacement. Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from another component, block or device), and/or retrieving (e.g., from a memory register or an array of storage elements).

Unless expressly limited by its context, the term "producing" is used to indicate any of its ordinary meanings, such as calculating, generating, and/or providing. Unless expressly limited by its context, the term "providing" is used to indicate any of its ordinary meanings, such as calculating, generating, and/or producing. Unless expressly limited by its context, the term "coupled" is used to indicate a direct or indirect electrical or physical connection. If the connection is indirect, it is well understood by a person having ordinary skill in the art, that there may be other blocks or components between the structures being "coupled".

The term "configuration" may be used in reference to a method, apparatus/device, and/or system as indicated by its particular context. Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). In the case (i) where A is based on B includes based on at least, this may include the configuration where A is coupled to B. Similarly, the term "in response to" is used to indicate any of its ordinary meanings, including "in response to at least." The term "at least one" is used to indicate any of its ordinary meanings, including "one or more". The term "at least two" is used to indicate any of its ordinary meanings, including "two or more".

The terms "apparatus" and "device" are used generically and interchangeably unless otherwise indicated by the particular context. Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The terms "method," "process," "procedure," and "technique" are used generically and interchangeably unless otherwise indicated by the particular context. The terms "element" and "module" may be used to indicate a portion of a greater configuration. Any incorporation by reference of a portion of a document shall also be understood to incorporate definitions of terms or variables that are referenced within the portion, where such definitions appear elsewhere in the document, as well as any figures referenced in the incorporated portion.

As used herein, the term "communication device" refers to an electronic device that may be used for voice and/or data communication over a wireless communication network. Examples of communication devices include cellular phones, personal digital assistants (PDAs), handheld devices, headsets, wireless modems, laptop computers, personal computers, etc.

Referring to FIG. 1, a particular embodiment of a system that is operable to perform bandwidth extension mode selection is shown and generally designated 100. In a particular embodiment, the system 100 may be integrated into a decoding system or apparatus (e.g., in a wireless telephone or coder/decoder (CODEC)). In other embodiments, the system 100 may be integrated into a set top box, a music player, a video player, an entertainment unit, a navigation device, a communications device, a personal digital assistant (PDA), a fixed location data unit, or a computer.

It should be noted that in the following description, various functions performed by the system 100 of FIG. 1 are described as being performed by certain components or modules. However, this division of components and modules is for illustration only. In an alternate embodiment, a function performed by a particular component or module may be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

Although illustrative embodiments depicted in FIGS. 1-7 are described with respect to a high-band model similar to that used in Enhanced Variable Rate Codec-Narrowband-Wideband (EVRC-NW), one or more of the illustrative embodiments may use any other high-band model. It should be understood that use of any particular model is described for example only.

The system 100 includes a first device 104 in communication with a second device 106 via a network 120. The first device 104 may be coupled to or in communication with a microphone 146. The first device 104 may include an encoder 114. The second device 106 may be coupled to or in communication with a speaker 142. The second device 106 may include a decoder 116. The decoder 116 may include a bandwidth extension module 118.

During operation, the first device 104 may receive an audio signal 130 (e.g., a user speech signal of a first user 152). For example, the first user 152 may be engaged in a voice call with a second user 154. The first user 152 may use the first device 104 and the second user 154 may use the second device 106 for the voice call. During the voice call, the first user 152 may speak into the microphone 146 coupled to the first device 104. The audio signal 130 may correspond to multiple words, a word, or a portion of a word spoken by the first user 152. The audio signal 130 may correspond to background noise (e.g., music, street noise, another person's speech, etc.). The first device 104 may receive the audio signal 130 via the microphone 146.

In a particular embodiment, the microphone 146 may capture the audio signal 130 and an analog-to-digital converter (ADC) at the first device 104 may convert the captured audio signal 130 from an analog waveform into a digital waveform comprised of digital audio samples. The digital audio samples may be processed by a digital signal processor. A gain adjuster may adjust a gain (e.g., of the analog waveform or the digital waveform) by increasing or decreasing an amplitude level of an audio signal (e.g., the analog waveform or the digital waveform). Gain adjusters may operate in either the analog or digital domain. For example, a gain adjuster may operate in the digital domain and may adjust the digital audio samples produced by the analog-to-digital converter. After gain adjusting, an echo canceller may reduce echo that may have been created by an output of a speaker entering the microphone 146. The digital audio samples may be "compressed" by a vocoder (a voice encoder-decoder). The output of the echo canceller may be coupled to vocoder pre-processing blocks, e.g., filters, noise processors, rate converters, etc. An encoder (e.g., the encoder 114) of the vocoder may compress the digital audio samples and form a transmit packet (a representation of the compressed bits of the digital audio samples). For example, the encoder may use watermarking to "hide" high band information in a narrow band bit stream.

Watermarking or data hiding in speech codec bit streams may enable transmission of extra data in-band with no changes to network infrastructure.

Watermarking may be used for a range of applications (e.g., authentication, data hiding, etc.) without incurring the costs of deploying new infrastructure for a new codec. One possible application may be bandwidth extension, in which one codec's bit stream (e.g., a deployed codec) is used as a carrier for hidden bits containing information for high quality bandwidth extension. Decoding the carrier bit stream and the hidden bits may enable synthesis of an audio signal having a bandwidth that is greater than the bandwidth of the carrier codec (e.g., a wider bandwidth may be achieved without altering the network infrastructure).

For example, a narrowband codec may be used to encode a 0-4 kilohertz (kHz) low-band part of speech, while a 4-7 kHz high-band part of the speech may be encoded separately. The bits for the high band may be hidden within the narrowband speech bit stream. In this example, a wideband audio signal may be decoded at the receiver that receives a legacy narrowband bit stream. In another example, a wideband codec may be used to encode a 0-7 kHz low-band part of speech, while a 7-14 kHz high-band part of the speech is encoded separately and hidden in a wideband bit stream. In this example, a super-wideband audio signal may be decoded at the receiver that receives a legacy wideband bit stream.

A watermark may be adaptive. The encoder 114 may compress an audio signal (e.g., speech) using linear prediction (LP) coding. The encoder 114 may receive a particular number (e.g., 80 or 160) of audio samples per frame of the audio signal. In a particular embodiment, the encoder 114 may perform code excitation linear prediction (CELP) to compress the audio signal. For example, the encoder 114 may generate an excitation signal corresponding to a sum of an adaptive codebook contribution and a fixed codebook contribution. The adaptive codebook contribution may provide a periodicity (e.g., pitch) of the excitation signal and the fixed codebook contribution may provide a remainder.

Each frame of the audio signal may correspond to a particular number of sub-frames. For example, a 20 millisecond (ms) frame of 160 samples may correspond to four 5 ms sub-frames of 40 samples each. Each fixed codebook vector may have a particular number (e.g., 40) of components corresponding to a sub-frame excitation signal of a sub-frame having the particular number (e.g., 40) of samples. The positions (or components) of the vector may be labeled 0-39.

Each fixed codebook vector may contain a particular number (e.g., 5) of pulses. For example, a fixed codebook vector may contain one +/−1 pulse in each of a particular number (e.g., 5) of interleaved tracks. Each track may correspond to a particular number (e.g., 8) of positions (or bits).

In a particular embodiment, each sub-frame of 40 samples may correspond to 5 interleaved tracks with 8 positions per track. In some configurations, adaptive multi-rate narrow band (AMR-NB) 12.2 (where 12.2 may refer to a bit rate of 12.2 kilobits per second (kbps)) may be used. In AMR-NB 12.2, there are five tracks of eight positions per 40-sample sub-frame.

For example, the positions 0, 5, 10, 15, 20, 25, 30, and 35 of the fixed codebook vector may form track 0. As another example, the positions 1, 6, 11, 16, 21, 26, 31, and 36 of the fixed codebook vector may form track 1. As a further example, the positions 2, 7, 12, 17, 22, 27, 32, and 37 of the fixed codebook vector may form track 2. As another example, the positions 3, 8, 13, 18, 23, 28, 33, and 38 of the fixed codebook vector may form track 3. As a further example, the positions 4, 9, 14, 24, 29, 34, and 39 of the fixed codebook vector may form track 4.

The encoder 114 may use a particular number (e.g., 2) of +/−1 pulses and one or more sign bits to encode a particular track. For example, the encoder 114 may encode two pulses and a sign bit per track, where an order of the pulses may determine a sign of the second pulse. A location of a pulse in 8 possible positions may be encoded using 3 bits. In this example, the encoder 114 may use 7 (i.e., 3+3+1) bits to encode each track and may use 35 (i.e., 7×5) bits to encode each sub-frame.

The encoder 114 may determine which tracks (e.g., track 0, track 1, track 2, track 3, and/or track 4) of a sub-frame have a higher priority. For example, the encoder 114 may identify a particular number (e.g., 2) of higher priority tracks based on an impact of the tracks on perceptual audio quality of a decoded sub-frame. The encoder 114 may identify the higher priority tracks using information present at both the encoder 114 and at the decoder 116, such that information indicating the higher priority tracks does not need to be additionally or separately transmitted. In one configuration, a long term prediction (LTP) contribution may be used to protect the higher priority tracks from the watermark. For instance, the LTP contribution may exhibit peaks at a main pitch pulse corresponding to a particular track, and may be available at both the encoder 114 and the decoder 116. To illustrate, the encoder 114 may identify two higher priority tracks corresponding to two highest absolute values of the LTP contribution. The encoder 114 may identify the three remaining tracks as lower priority tracks.

The encoder 114 may not watermark the two higher priority tracks and may watermark the lower priority tracks. For example, the encoder 114 may use a particular number (e.g., 2) of least significant bits of the bits (e.g., 7 bits) corresponding to each of the lower priority tracks to encode the watermark. For example, the encoder 114 may generate 6 (i.e., 2×3) bits of watermark per 5 ms sub-frame, for a total of 1.2 kilobits per second (kbps) carried in the watermark with reduced (e.g., minimal) impact to a main pitch pulse.

The LTP signal may be sensitive to errors and packet losses and errors may propagate over time, leading to the encoder 114 and decoder 116 being out of sync for long periods after an erasure or bit errors in an encoded audio signal received by the decoder 116. In a particular embodiment, the encoder 114 and the decoder 116 may use a memory-limited LTP contribution to identify the higher priority tracks. The memory-limited version of the LTP may be constructed based on quantized pitch values and codebook contributions of a particular frame and of a particular number (e.g., 2) of frames preceding the particular frame. Gains may be set to unity. Use of the memory-limited version of the LTP contribution by the encoder 114 and the decoder 116 may significantly improve performance in the presence of errors (e.g., transmission errors). In a particular embodiment, the original LTP contribution may be used for low band coding and the memory-limited LTP contribution may be used to identify higher priority tracks for watermarking purposes.

Encoding a watermark in tracks that have a lower impact on perceptual audio quality, rather than across all tracks, may result in improved quality of a decoded audio signal. In particular, a main pitch pulse may be preserved by not encoding the watermark in the higher priority tracks corresponding to the main pitch pulse. Preserving the main pitch pulse may have a positive impact on speech quality of the decoded audio signal.

In some configurations, the systems and methods disclosed herein may be used to provide a codec that is a backward interoperable version of AMR-NB 12.2. For convenience, this codec may be referred to as "eAMR" herein, though the codec could be referred to using a different term. eAMR may have an ability to transport a "thin" layer of wideband information hidden within a narrowband bit stream. eAMR may make use of watermarking (e.g., steganography) technology and does not rely on out-of-band signaling. The watermark used may have a negligible impact on narrowband quality (for legacy interoperation). With the watermark, narrowband quality may be slightly degraded in comparison with AMR 12.2, for example. In some configurations, an encoder, such as the encoder 114, may detect a legacy decoder of a receiving device (through not detecting a watermark on the return channel, for example) and may stop adding a watermark, returning to legacy AMR 12.2 operation.

The encoder 114 may generate a transmit packet corresponding to the compressed bits (e.g., 35 bits per sub-frame). The encoder 114 may store the transmit packet in a memory coupled to, or in communication with, the first device 104. For example, the memory may be accessible by a processor of the first device 104. The processor may be a control processor that is in communication with a digital signal processor. The first device 104 may transmit an input signal 102 (e.g., an encoded audio signal) to the second device 106 via the network 120. The input signal 102 may correspond to the audio signal 130. In a particular embodiment, the first device 104 may include a transceiver. The transceiver may modulate some form (other information may be appended to the transmit packet) of the transmit packet and send modulated information over the air via an antenna.

The bandwidth extension module 118 of the second device 106 may receive the input signal 102. For example, an antenna of the second device 106 may receive some form of incoming packets that comprise the transmit packet. The transmit packet may be "uncompressed" by a decoder (e.g., the decoder 116) of a vocoder at the second device 106. The uncompressed signal may be referred to as reconstructed audio samples. The reconstructed audio samples may be post-processed by vocoder post-processing blocks and may be used by an echo canceller to remove echo. For the sake of clarity, the decoder of the vocoder and the vocoder post-processing blocks may be referred to as a vocoder decoder module. In some configurations, an output of the echo canceller may be processed by the bandwidth extension module 118. Alternatively, in other configurations, the output of the vocoder decoder module may be processed by the bandwidth extension module 118.

The bandwidth extension module 118 may include an extractor to extract a first plurality of parameters from the input signal 102 and may also include a predictor to predict a second plurality of parameters independently of high band information in the input signal 102. For example, the bandwidth extension module 118 may extract watermark data from the input signal 102 and may determine the first plurality of parameters based on the watermark data. In a particular embodiment, the vocoder decoder module may be an eAMR decoder module. For example, the decoder 116 may be an eAMR decoder. The bandwidth extension module 118 may perform blind bandwidth extension by using the predictor to generate the second plurality of parameters independent of high band information of the input signal 102.

The bandwidth extension module 118 may select a particular mode from multiple high band modes for reproduction of a high band portion of the audio signal 130 and may generate an output signal 128 based on the particular mode, as described with reference to FIGS. 2-5. For example, the multiple high band modes may include a first mode using extracted high band parameters, a second mode using predicted high band parameters, a third mode independent of high band parameters, or a combination thereof. The bandwidth extension module 118 may generate the output signal 128 using extracted high band parameters, using predicted high band parameters, or independent of high band parameters based on a selected mode.

The output signal 128 may be amplified or suppressed by a gain adjuster. The second device 106 may provide the output signal 128, via the speaker 142, to the second user 154. For example, the output of the gain adjuster may be converted from a digital signal to an analog signal by a digital-to-analog converter, and played out via the speaker 142.

The system 100 may enable switching between using an extracted plurality of parameters, using a generated plurality of parameters, or using no high band parameters to generate an output signal. Using the generated plurality of parameters may enable generation of a high band audio signal in the presence of errors associated with the extracted plurality of parameters. Thus, the system 100 may enable enhanced audio signal reproduction in the presence of errors occurring in the input signal 102.

Figure 2:
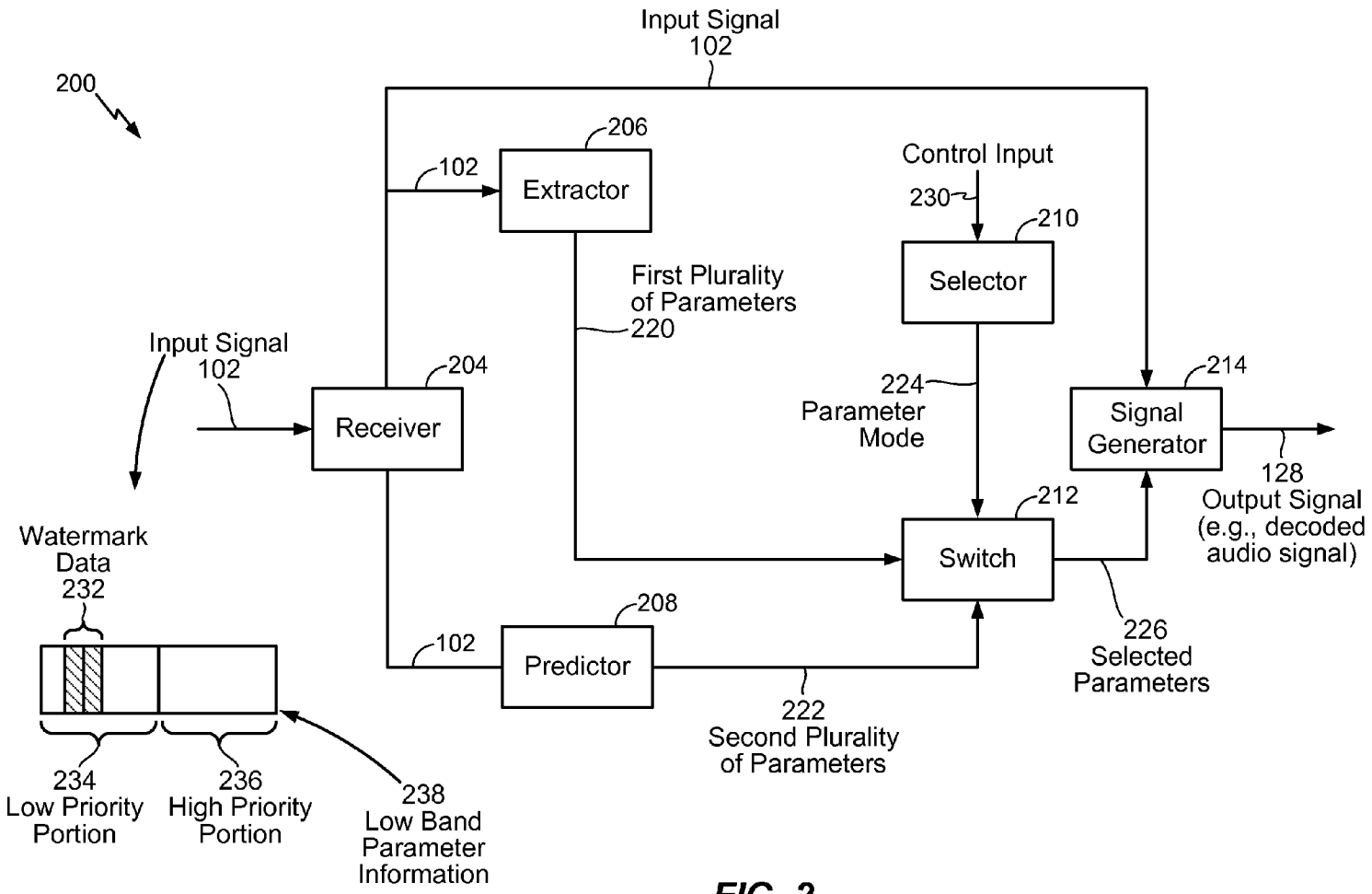
FIG. 2 is a diagram to illustrate another particular embodiment of a system that is operable to perform bandwidth extension mode selection.

Referring to FIG. 2, an illustrative embodiment of a system that is operable to perform bandwidth extension mode selection is shown and generally designated 200. In a particular embodiment, the system 200 may correspond to, or be included in, the system 100 (or one or more components of the system 100) of FIG. 1. For example, one or more components of the system 200 may be included in the bandwidth extension module 118 of FIG. 1.

The system 200 includes a receiver 204. The receiver 204 may be coupled to, or in communication with, an extractor 206 and a predictor 208. The extractor 206, the predictor 208, and a selector 210 may be coupled to a switch 212. The receiver 204 and the switch 212 may be coupled to a signal generator 214.

During operation, the receiver 204 may receive an input signal (e.g., the input signal 102 of FIG. 1). The input signal 102 may correspond to an input bit stream. The receiver 204 may provide the input signal 102 to the extractor 206, to the predictor 208, and to the signal generator 214. The input signal 102 may or may not include high band parameter information associated with a high band portion of the audio signal 130. For example, the encoder 114 at the first device 104 may or may not generate the input signal 102 including the high band parameter information. To illustrate, the encoder 114 may not be configured to generate the high band parameter information. Even if the encoder 114 generates the input signal 102 to include the high band parameter information, the high band parameter information may not be received by the receiver 204 (e.g., due to transmission errors). In a particular embodiment, the input signal 102 may include watermark data 232 corresponding to high band parameter information. For example, the encoder 114 may embed the watermark data 232 in-band with a low band bit stream corresponding to a low band portion of the audio signal 130.

The extractor 206 may extract a first plurality of parameters 220 from the input signal 102. The first plurality of parameters 220 may correspond to the high band parameter information. For example, the first plurality of parameters 220 may include at least one of line spectral frequencies (LSF), gain shape (e.g., temporal gain parameters corresponding to sub-frames of a particular frame), gain frame (e.g., gain parameters corresponding to an energy ratio of high-band to low-band for a particular frame), or other parameters corresponding to the high band portion. In a particular embodiment, one or more of the first plurality of parameters 220 may correspond to a particular high-band model. For example, the particular high-band model may use high-band extension in a frequency domain, LSFs, temporal gains, or a combination thereof.

The extractor 206 may determine a location of the input signal 102 where the high band parameter information would be embedded if the input signal 102 includes the high band parameter information. For example, the high band parameter information may be embedded with low band parameter information 238 in the input signal 102. The low band parameter information 238 may correspond to low band parameters associated with a low band portion of the input signal 102. As another example, the input signal 102 may include the watermark data 232 encoding the high band parameter information (e.g., the first plurality of parameters 220). In a particular embodiment, the extractor 206 may determine the location based on a codebook (e.g., a fixed codebook (FCB)). For example, the codebook may be indexed by a number of tracks used in an audio encoding process of the input signal 102. The extractor 206 may determine (or designate) a number of tracks (e.g., two) that have a largest long term prediction (LTP) contribution as high priority tracks, while the other tracks may be determined (or designated) as low priority tracks. In a particular embodiment, the low priority tracks may correspond to a low priority portion 234 and the high priority tracks may correspond to a high priority portion 236 of the input signal 102. The extractor 206 may extract the first plurality of parameters 220 from the determined location. For example, the extractor 206 may extract the first plurality of parameters 220 from the low priority portion 234. The first plurality of parameters 220 may correspond to the high band parameters if the input signal 102 includes the high band parameter information. If the input signal 102 does not include the high band parameter information, the first plurality of parameters 220 may correspond to random data. The extractor 206 may provide the first plurality of parameters 220 to the switch 212.

The predictor 208 may receive the input signal 102 from the receiver 204 and may generate a second plurality of parameters 222. The second plurality of parameters 222 may correspond to the high band portion of the input signal 102. The predictor 208 may generate the second plurality of parameters 222 based on low band parameter information extracted from the input signal 102. The predictor 208 may generate the second plurality of parameters 222 by performing blind bandwidth extension based on the low band parameter information, as further described with reference to FIG. 3. In a particular embodiment, the predictor 208 may generate the second plurality of parameters 222 based on a particular high-band model. For example, the particular high-band model may use high-band extension in a frequency domain, LSFs, temporal gains, or a combination thereof.

The predictor 208 may provide the second plurality of parameters 222 to the switch 212. In a particular embodiment, the first plurality of parameters 220 may be extracted by the extractor 206 concurrently with the predictor 208 generating the second plurality of parameters 222.

The selector 210 may select a particular mode from multiple high band modes for reproduction of the high band portion of the encoded audio signal. The multiple high band modes may include a first mode using extracted high band parameters (e.g., the first plurality of parameters 220) and a second mode using predicted high band parameters (e.g., the second plurality of parameters 222). The selector 210 may select the particular mode based on a control input 230 (e.g., a control input signal). The control input 230 may correspond to a user input and may indicate a user setting or preference. In a particular embodiment, the control input 230 may be provided by a processor to the selector 210. The processor may generate the control input 230 in response to receiving information regarding the encoder from the other device or receiving information regarding the communication network from one or more other devices. For example, the control input 230 may indicate to use predicted high band parameters in response to the processor receiving information indicating that the encoder is not including the high band parameters in the input signal 102, receiving information indicating that the communication network is experiencing transmission errors, or both. The control input 230 may have a default value (e.g., 1 or 2). The selector 210 may select the first mode in response to the control input 230 indicating a first value (e.g., 1) and may select the second mode in response to the control input 230 indicating a second value (e.g., 2). The selector 210 may send a parameter mode 224 to the switch 212. The parameter mode 224 may indicate the selected mode (e.g., the first mode or the second mode).

In a particular embodiment, the multiple high band modes may also include a third mode independent of any high band parameters. The selector 210 may select the first mode in response to the control input 230 indicating a first value (e.g., 1), may select the second mode in response to the control input 230 indicating a second value (e.g., 2), and may select the third mode in response to the control input 230 indicating a third value (e.g., 0). The selector 210 may send a parameter mode 224 to the switch 212 indicating the selected mode (e.g., the first mode, the second mode, or the third mode).

The switch 212 may receive the first plurality of parameters 220 from the extractor 206, the second plurality of parameters 222 from the predictor 208, and the parameter mode 224 from the selector 210. The switch 212 may provide selected parameters 226 (e.g., the first plurality of parameters 220, the second plurality of parameters 222, or no high band parameters) to the signal generator 214 based on the parameter mode 224. For example, the switch 212 may provide the first plurality of parameters 220 to the signal generator 214 in response to the parameter mode 224 indicating the first mode. The switch 212 may provide the second plurality of parameters 222 to the signal generator 214 in response to the parameter mode 224 indicating the second mode. The switch 212 may provide no high band parameters to the signal generator 214 in response to the parameter mode 224 indicating the third mode, so that no high band parameters are used by the signal generator 214.

The signal generator 214 may receive the input signal 102 from the receiver 204 and may receive the selected parameters 226 from the switch 212. The signal generator 214 may generate an output high band portion based on the selected parameters 226 and the input signal 102. For example, if the selected parameters 226 correspond to high band parameters (e.g., the first plurality of parameters 220 or the second plurality of parameters 222), the signal generator 214 may model and/or decode the selected parameters 226 to generate the output high band portion. For example, the signal generator 214 may use a particular high-band model to generate the output high band portion. As an illustrative example, the particular high-band model may use high-band extension in a frequency domain, LSFs, temporal gains, or a combination thereof. The particular high-band model used for a higher frequency band may depend on a decoded lower band signal. The signal generator 214 may generate an output low band portion based on the input signal 102. For example, the signal generator 214 may extract, model, and/or decode the low band parameters from the input signal 102 to generate the output low band portion. The output low band portion may be used to generate the output high band portion. The signal generator 214 may generate an output signal 128 (e.g., a decoded audio signal) by combining the output low band portion and the output high band portion. The signal generator 214 may transmit the output signal 128 to a playback device (e.g., a speaker).

If no high band parameters are provided to the signal generator 214, the signal generator 214 may generate the output low band portion and may refrain from generating the output high band portion. In this case, the output signal 128 may correspond to only low band audio.

In a particular embodiment, the input signal 102 may be a super wideband (SWB) signal that includes data in the frequency range from approximately 50 hertz (Hz) to approximately 16 kilohertz (kHz). The low band portion of the input signal 102 and the high band portion of the input signal 102 may occupy non-overlapping frequency bands of 50 Hz-7 kHz and 7 kHz-16 kHz, respectively. In an alternate embodiment, the low band portion and the high band portion may occupy non-overlapping frequency bands of 50 Hz-8 kHz and 8 kHz-16 kHz, respectively. In another alternate embodiment, the low band portion and the high band portion may overlap (e.g., 50 Hz-8 kHz and 7 kHz-16 kHz, respectively).

In a particular embodiment, the input signal 102 may be a wideband (WB) signal having a frequency range of approximately 50 Hz to approximately 8 kHz. In such an embodiment, the low band portion of the input signal 102 may correspond to a frequency range of approximately 50 Hz to approximately 6.4 kHz and the high band portion of the input signal 102 may correspond to a frequency range of approximately 6.4 kHz to approximately 8 kHz.

The system 200 of FIG. 2 may enable dynamically switching between using extracted high band parameters, using predicted high band parameters, and using no high band parameters based on a control input (e.g., the control input 230). In a particular embodiment, the control input 230 may change to conserve resources (e.g., battery, processor, or both) of the system 200. For example, the control input 230 may indicate that no high band parameters are to be used based on user input indicating that the resources are to be conserved or based on detecting that resource availability (e.g., associated with the battery, the processor, or both) does not satisfy a particular threshold level. The resources of the system 200 may be conserved by not generating high band audio when the control input 230 indicates that no high band parameters are to be used. In another embodiment, the control input 230 may indicate to use predicted high band parameters in response to a processor receiving the information indicating that the encoder is not including the high band parameters in the input signal 102, receiving the information indicating that the communication network is experiencing transmission errors, or both. Using predicted high band parameters may conceal the absence of, or errors associated with, the high band parameters. Thus, the system 200 may enable resource conservation, error concealment, or both.

Figure 3:
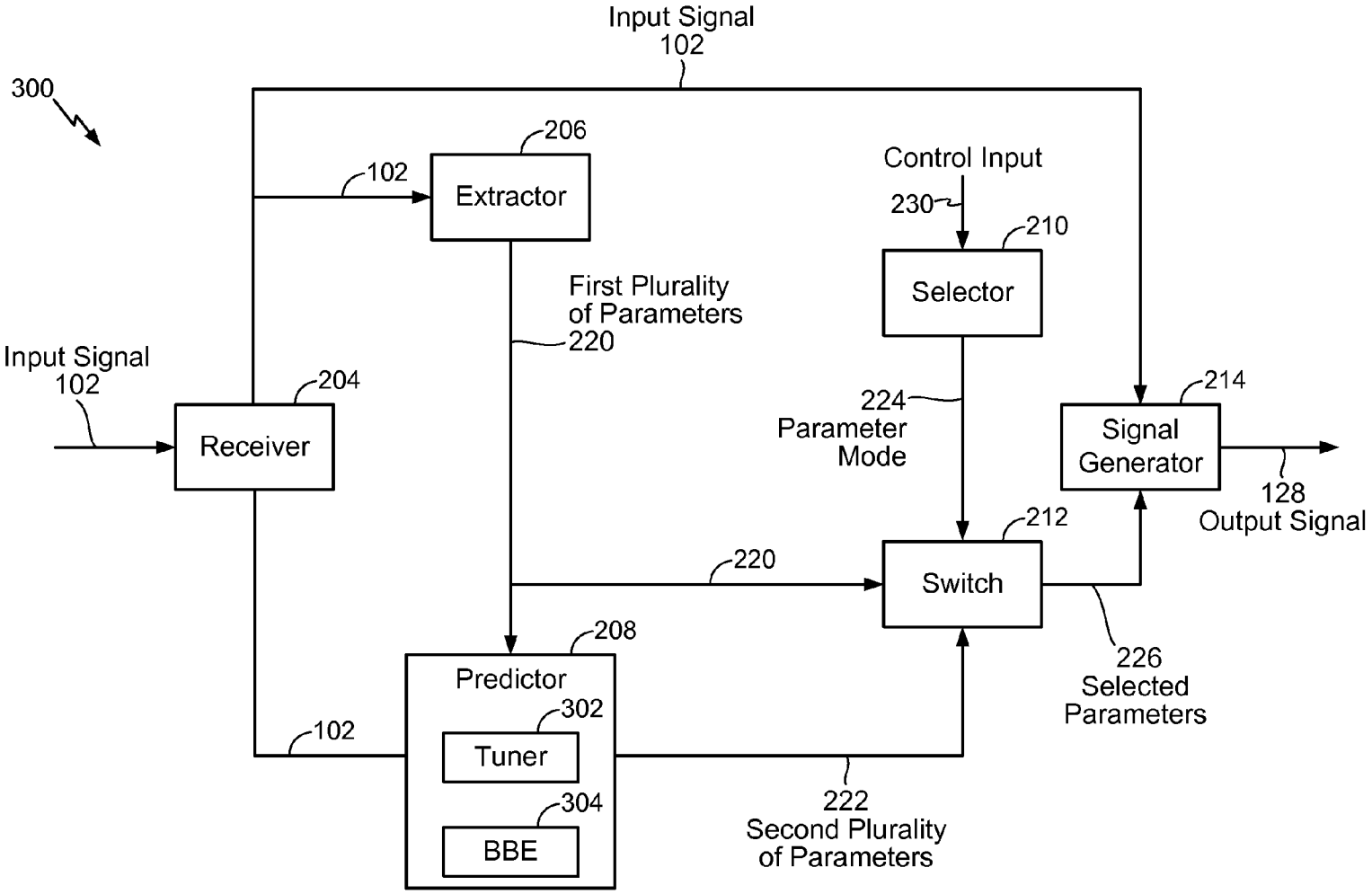
FIG. 3 is a diagram to illustrate another particular embodiment of a system that is operable to perform bandwidth extension mode selection.

Referring to FIG. 3, another particular embodiment of a system that is operable to perform bandwidth extension mode selection is disclosed and generally designated 300. In a particular embodiment, the system 300 may correspond to, or be included in, the system 100 (or one or more components of the system 100) of FIG. 1. For example, one or more components of the system 300 may be included in the bandwidth extension module 118 of FIG. 1. The system 300 includes the receiver 204, the extractor 206, the predictor 208, the selector 210, the switch 212, and the signal generator 214. In FIG. 3, the extractor 206 is coupled to the predictor 208. The predictor 208 may include a blind bandwidth extender (BBE) 304 and a tuner 302.

During operation, the extractor 206 may provide the first plurality of parameters 220 to the predictor 208. The BBE 304 may generate the second plurality of parameters 222 by performing blind bandwidth extension based on the low band portion of the input signal 102. For example, the BBE 304 may generate the second plurality of parameters 222 independent of any high band information in the input signal 102. The BBE 304 may have access to parameter data indicating particular high band parameters corresponding to particular low band parameters. The parameter data may be generated based on training audio samples. For example, each training audio sample may include low band audio and high band audio. Correlation between particular low band parameters and particular high band parameters may be determined based on the low band audio and the high band audio of the training audio samples. The parameter data may indicate the correlation between the particular low band parameters and the particular high band parameters. The BBE 304 may use the parameter data and the low band parameters of the input signal 102 to predict the second plurality of parameters 222. The BBE 304 may receive the parameter data via user input. Alternatively, the parameter data may have default values.

In a particular embodiment, the BBE 304 may generate the second plurality of parameters 222 based on analysis data. The analysis data may include data associated with the first plurality of parameters 220 (e.g., a first gain frame and/or first average line spectral frequencies (LSFs)). The analysis data may include historical data (e.g., a predicted gain frame and/or historical average line spectral frequencies (LSFs)) associated with previously received input signals. For example, the BBE 304 may generate the second plurality of parameters 222 based on the predicted gain frame. The tuner 302 may adjust the predicted gain frame based on a ratio of a first gain frame of the first plurality of parameters 220 to a second gain frame of the second plurality of parameters 222.

As another example, an average LSF associated with an input signal (e.g., the input signal 102) may indicate a spectral tilt. The BBE 304 may use the historical average LSFs to bias the second plurality of parameters 222 to better match the spectral tilt indicated by the historical average LSFs. The tuner 302 may adjust the historical average LSFs based on the average LSFs extracted for a current frame of the input signal 102. For example, the tuner 302 may adjust the historical average LSFs based on the first average LSFs. In a particular embodiment, the BBE 304 may generate the second plurality of parameters 222 based on the average extracted LSFs for the current frame. For example, the BBE 304 may bias the second plurality of parameters 222 based on the first average LSFs.

The system 300 may enable dynamically switching between using extracted high band parameters, using predicted high band parameters, and using no high band parameters based on a control input (e.g., the control input 230). In addition, the system 300 may reduce artifacts when switching between using extracted high band parameters and using predicted high band parameters by adapting the predicted high band parameters based on analysis data associated with received high band parameters.

Figure 4:
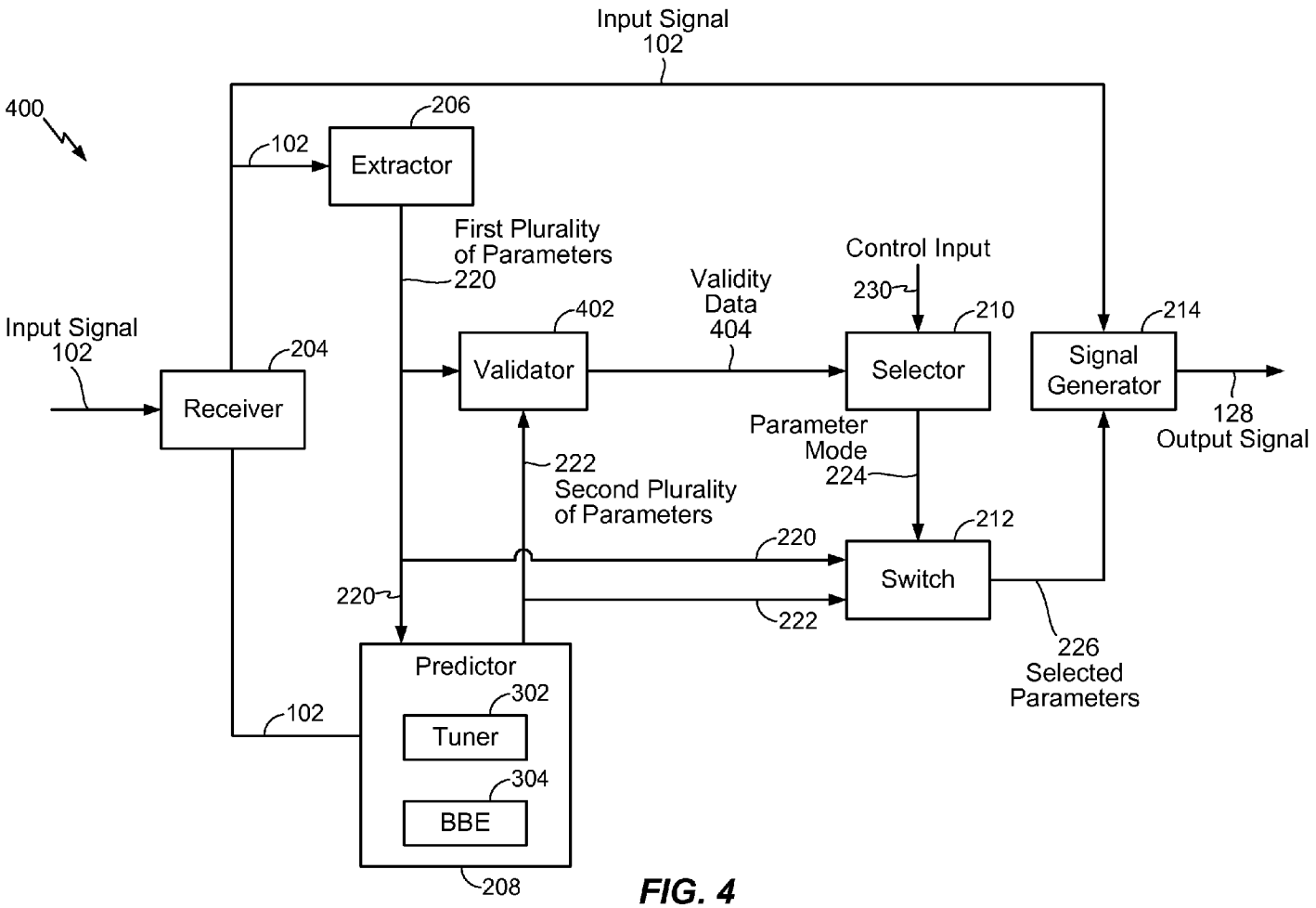
FIG. 4 is a diagram to illustrate another particular embodiment of a system that is operable to perform bandwidth extension mode selection.

Referring to FIG. 4, another particular embodiment of a system operable to perform bandwidth extension mode selection is disclosed and generally designated 400. In a particular embodiment, the system 400 may correspond to, or be included in, the system 100 (or one or more components of the system 100) of FIG. 1. For example, one or more components of the system 400 may be included in the bandwidth extension module 118 of FIG. 1.

The system 400 includes the receiver 204, the extractor 206, the predictor 208, the selector 210, the switch 212, the signal generator 214, the tuner 302, and the BBE 304. The system 400 also includes a validator 402 (e.g., a parameter validity checker) coupled to the extractor 206, the predictor 208, and the selector 210.

During operation, the validator 402 may receive the first plurality of parameters 220 from the extractor 206 and may receive the second plurality of parameters 222 from the predictor 208. The validator 402 may determine a "reliability" of the first plurality of parameters 220 based on a comparison of the first plurality of parameters 220 and the second plurality of parameters 222. For example, the validator 402 may determine the reliability of the first plurality of parameters 220 based on a difference (e.g., absolute values, standard deviation, etc.) between the first plurality of parameters 220 and the second plurality of parameters 222. To illustrate, the reliability may be inversely related to the difference. The validator 402 may generate validity data 404 indicating the determined reliability. The validator 402 may provide the validity data 404 to the selector 210.

The selector 210 may determine whether the first plurality of parameters 220 is reliable or is too unreliable to use in signal reconstruction based on whether the validity data 404 satisfies (e.g., exceeds) a reliability threshold. For example, the difference between the first plurality of parameters 220 and the second plurality of parameters 222 may indicate that there is an error (e.g., corrupted/missing data) associated with transmission of the high band parameter information. As another example, the difference may indicate that the first plurality of parameters 220 corresponds to random data (e.g., when the input signal 102 is generated by the encoder to not include high band parameters).

The selector 210 may receive the reliability threshold via user input. The reliability threshold may correspond to user settings and/or preferences. Alternatively, the reliability threshold may have a default value. In a particular embodiment, the control input 230 may include a value corresponding to the reliability threshold.

The selector 210 may select a particular mode of the multiple high band modes based on the validity data 404. For example, the selector 210 may select the first mode that uses the first plurality of parameters 220 in response to the validity data 404 satisfying (e.g., exceeding) the reliability threshold. The selector 210 may select the second mode that uses the second plurality of parameters 222 in response to the validity data 404 not satisfying (e.g., not exceeding) the reliability threshold. Alternatively, the selector 210 may select the third mode in response to the validity data 404 not satisfying the reliability threshold.

In a particular embodiment, the selector 210 may select a particular mode based on the validity data 404 and the control input 230. For example, the selector 210 may select the first mode when the validity data 404 satisfies the reliability threshold. The selector 210 may select the second mode when the validity data 404 does not satisfy the reliability threshold and the control input 230 indicates a first value (e.g., true). The selector 210 may select the third mode when the validity data 404 does not satisfy the reliability threshold and the control input 230 indicates a second value (e.g., false).

The system 400 may enable dynamic switching between using extracted high band parameters, using predicted high band parameters, and using no high band parameters based on a reliability of high band parameter information in a received input signal. When received high band parameter information is reliable, the extracted high band parameters may be used. When the received high band parameter information is unreliable, the predicted high band parameters may be used to conceal errors associated with the received high band parameter information. In a particular embodiment, the system 400 may enable the high band parameter information in the input signal 102 to be encoded using a smaller amount of redundancy and error detection prior to transmission to the receiver 204. The encoder may rely on the system 400 to have access to the predicted high band parameters for comparison to determine reliability of the extracted high band parameters.

Figure 5:
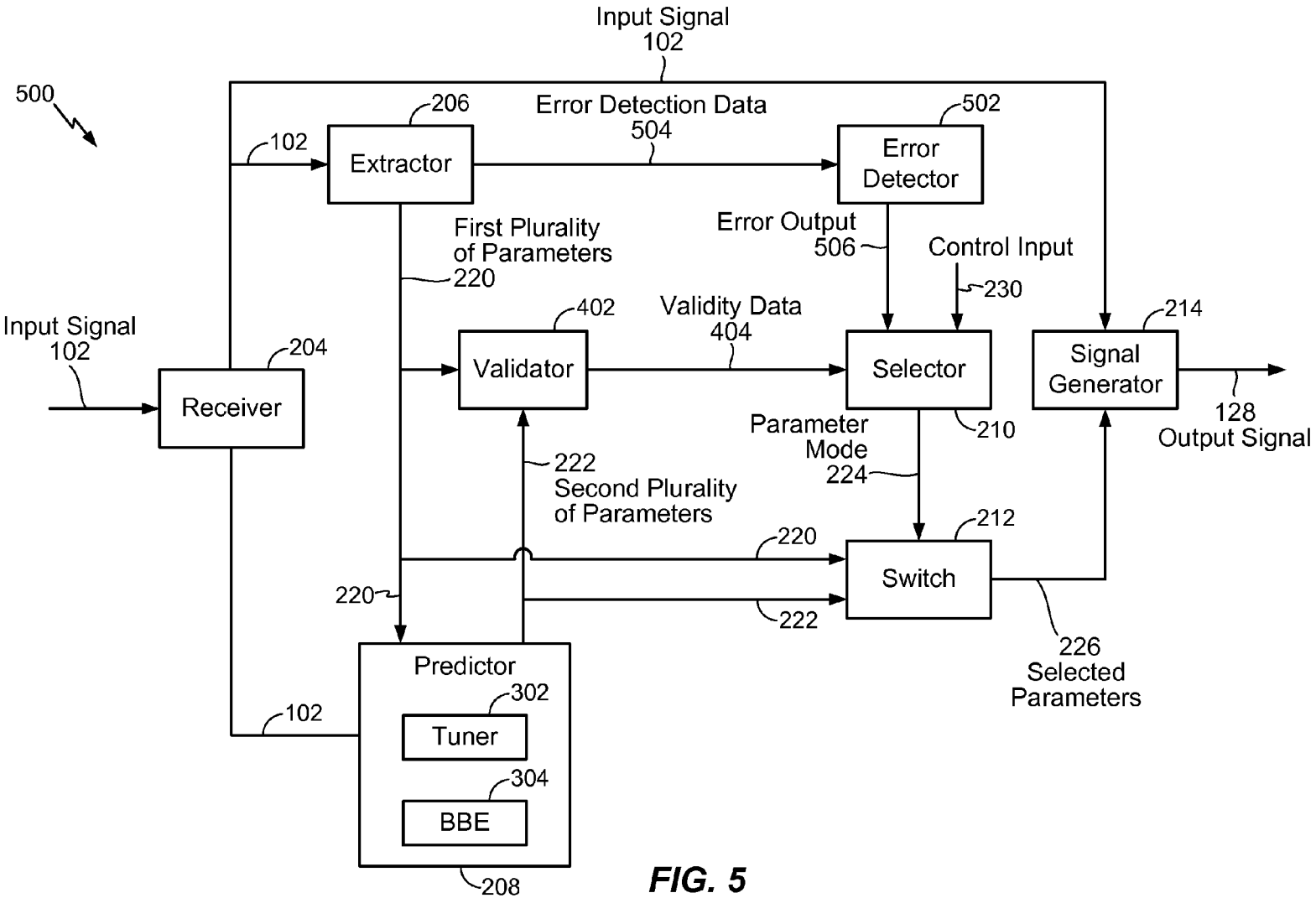
FIG. 5 is a diagram to illustrate another particular embodiment of a system that is operable to perform bandwidth extension mode selection.

Referring to FIG. 5, another particular embodiment of a system operable to perform bandwidth extension mode selection is disclosed and generally designated 500. In a particular embodiment, the system 500 may correspond to, or be included in, the system 100 (or one or more components of the system 100) of FIG. 1. For example, one or more components of the system 500 may be included in the bandwidth extension module 118 of FIG. 1.

The system 500 includes the receiver 204, the extractor 206, the predictor 208, the selector 210, the switch 212, the signal generator 214, the tuner 302, the BBE 304, and the validator 402. The system 500 also includes an error detector 502 coupled to the extractor 206 and the selector 210.

During operation, the extractor 206 may provide error detection data 504 to the error detector 502. For example, the extractor 206 may extract the error detection data 504 from the input signal 102. The error detection data 504 may be associated with the high band parameter information. For example, the error detection data 504 may correspond to cyclic redundancy check (CRC) data associated with the high band parameter information.

The error detector 502 may analyze the error detection data 504 to determine whether there is an error associated with the high band parameter information. For example, the error detector 502 may detect an error in response to determining that the CRC data (e.g., 4 bits) indicates invalid data. The error detector 502 may not detect any errors in response to determining that the CRC data indicates valid data. Using additional bits to represent the error detection data 504 may increase the probability of detecting errors associated with transmission of the high band parameter information but may increase a number of bits used in transmitting high band information.

In a particular embodiment, the error detector 502 may maintain state indicating a historical error rate (e.g., an average error rate of erroneous frames based on CRC checks). This historical error rate may be used to determine if the input signal 102 contains valid high band parameter information. For example, the historical error rate may be used to determine whether the CRC data associated with the input signal 102 indicates a false positive. To illustrate, the CRC data associated with the input signal 102 may indicate valid data even when the input signal 102 does not include high band parameter information and the first plurality of parameters 220 represents random data. The error detector 502 may detect an error in response to determining that the average error rate satisfies (e.g., exceeds) a threshold error rate. For example, the error detector 502 may determine that the encoder is not transmitting high band parameter information based on the historical error rate satisfying (e.g., exceeding) a threshold error rate. For example, the error detector 502 may detect the error in response to determining that the average error rate indicates an error associated with more than a threshold number (e.g., 6) of frames of a number (e.g., 16) of most recently received frames. The error detector 502 may receive the threshold error rate via user input corresponding to a user setting or preference. Alternatively, the threshold error rate may have a default value.

The error detector 502 may provide an error output 506 to the selector 210 indicating whether the error is detected. For example, the error output 506 may have a first value (e.g., 0) to indicate that no errors are detected by the error detector 502. The error output 506 may have a second value (e.g., 1) to indicate that at least one error is detected by the error detector 502. For example, the error output 506 may have the second value (e.g., 1) in response to determining that the error detection data 504 (e.g., CRC data) indicates invalid data. As another example, the error output 506 may have the second value (e.g., 1) in response to determining that the average error rate does not satisfy a threshold error rate.

The selector 210 may select a high band mode based on the error output 506. For example, the selector 210 may select the first mode that uses the first plurality of parameters 220 in response to determining that the error output 506 has the first value (e.g., 0). The selector 210 may select the second mode or the third mode in response to determining that the error output 506 has the second value (e.g., 1).

In a particular embodiment, the selector 210 may select the high band mode based on the error output 506 and the validity data 404. For example, the selector 210 may select the first mode in response to determining that the error output 506 has the first value (e.g., 0) and that the validity data 404 satisfies (e.g., exceeds) the reliability threshold. The selector 210 may select the second mode or the third mode in response to determining that the error output 506 has the second value (e.g., 1) or that the validity data 404 does not satisfy (e.g., does not exceed) the reliability threshold.

In a particular embodiment, the selector 210 may select the high band mode based on the error output 506, the validity data 404, and the control input 230. For example, the selector 210 may select the first mode in response to determining that the control input 230 indicates a first value (e.g., true), that the error output 506 has the first value (e.g., 0), and that the validity data 404 satisfies (e.g., exceeds) the reliability threshold. As another example, the selector 210 may select the second mode in response to determining that the control input 230 indicates a first value (e.g., true) and determining that the error output 506 has the second value (e.g., 1) or that the validity data 404 does not satisfy (e.g., does not exceed) the reliability threshold. The selector may select the third mode in response to determining that the control input 230 indicates a second value (e.g., false).

The system 500 may enable switching between using extracted high band parameters, using predicted high band parameters, and using no high band parameters based on a control input (e.g., the control input 230), reliability of received high band parameter information (e.g., as indicated by the validity data 404), and/or received error detection data (e.g., the error detection data 504). The system 500 may enable conservation of resources by refraining from generating high band audio when the control input indicates that no high band parameters are to be used. When the high band audio is generated, the system 500 may conceal errors associated with received high band parameter information by generating the high band audio using the predicted high band parameters in response to detecting errors associated with the received high band parameters or determining that the received high band parameters are unreliable.

Figure 6:
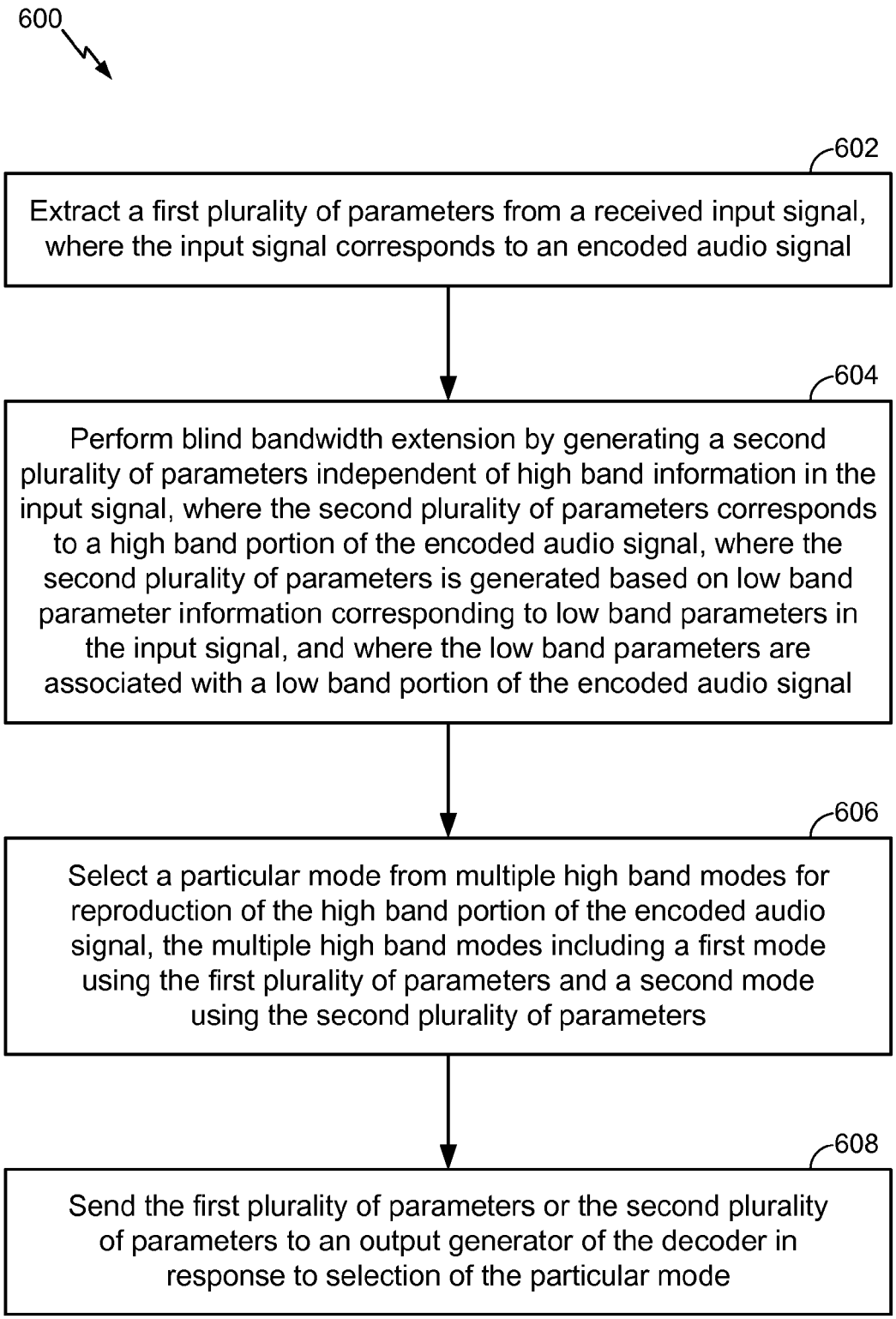
FIG. 6 is a flowchart to illustrate a particular embodiment of a method of bandwidth extension mode selection.

Referring to FIG. 6, a flowchart of a particular embodiment of a method of bandwidth extension mode selection is shown and generally designated 600. The method 600 may be performed by one or more components of the systems 100-500 of FIGS. 1-5. For example, the method 600 may be performed at a decoder, such as by one or more components of the bandwidth extension module 118 of the decoder 116 of FIG. 1.

The method 600 includes extracting a first plurality of parameters from a received input signal, at 602. The input signal may correspond to an encoded audio signal. For example, the extractor 206 of FIGS. 2-5 may extract the first plurality of parameters 220 from the input signal 102, as further described with reference to FIG. 2. The input signal 102 may correspond to an encoded audio signal.

The method 600 also includes performing blind bandwidth extension by generating a second plurality of parameters independent of high band information in the input signal, at 604. The second plurality of parameters may correspond to a high band portion of the encoded audio signal. The second plurality of parameters may be generated based on low band parameter information corresponding to low band parameters in the input signal. The low band parameters may be associated with a low band portion of the encoded audio signal. For example, the predictor 208 of FIG. 2-5 may generate the second plurality of parameters 222, as further described with reference to FIGS. 2-3. The second plurality of parameters 222 may correspond to a high band portion of the input signal 102. The predictor 208 may generate the second plurality of parameters 222 based on low band parameter information corresponding to low band parameters of the input signal 102.

The method 600 further includes selecting a particular mode from multiple high band modes for reproduction of the high band portion of the encoded audio signal, at 606. For example, the selector 210 of FIGS. 2-5 may select a particular mode from multiple high band modes, as further described with reference to FIGS. 2-5. The multiple high band modes may include a first mode using the first plurality of parameters and a second mode using the second plurality of parameters.

The method 600 may also include sending the first plurality of parameters or the second plurality of parameters to an output generator of the decoder in response to selection of the particular mode, at 608. For example, the switch 212 of FIG. 2-5 may send the selected parameters 226 to the signal generator 214 in response to selection of the particular mode, as further described with reference to FIGS. 2-5. The selected parameters 226 may correspond to the first plurality of parameters 220 or to the second plurality of parameters 222.

The method 600 of FIG. 6 may enable dynamic switching between using extracted high band parameters and using predicted high band parameters.

In particular embodiments, the method 600 of FIG. 6 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 600 of FIG. 6 can be performed by a processor that executes instructions, as described with respect to FIG. 7.

Figure 7:
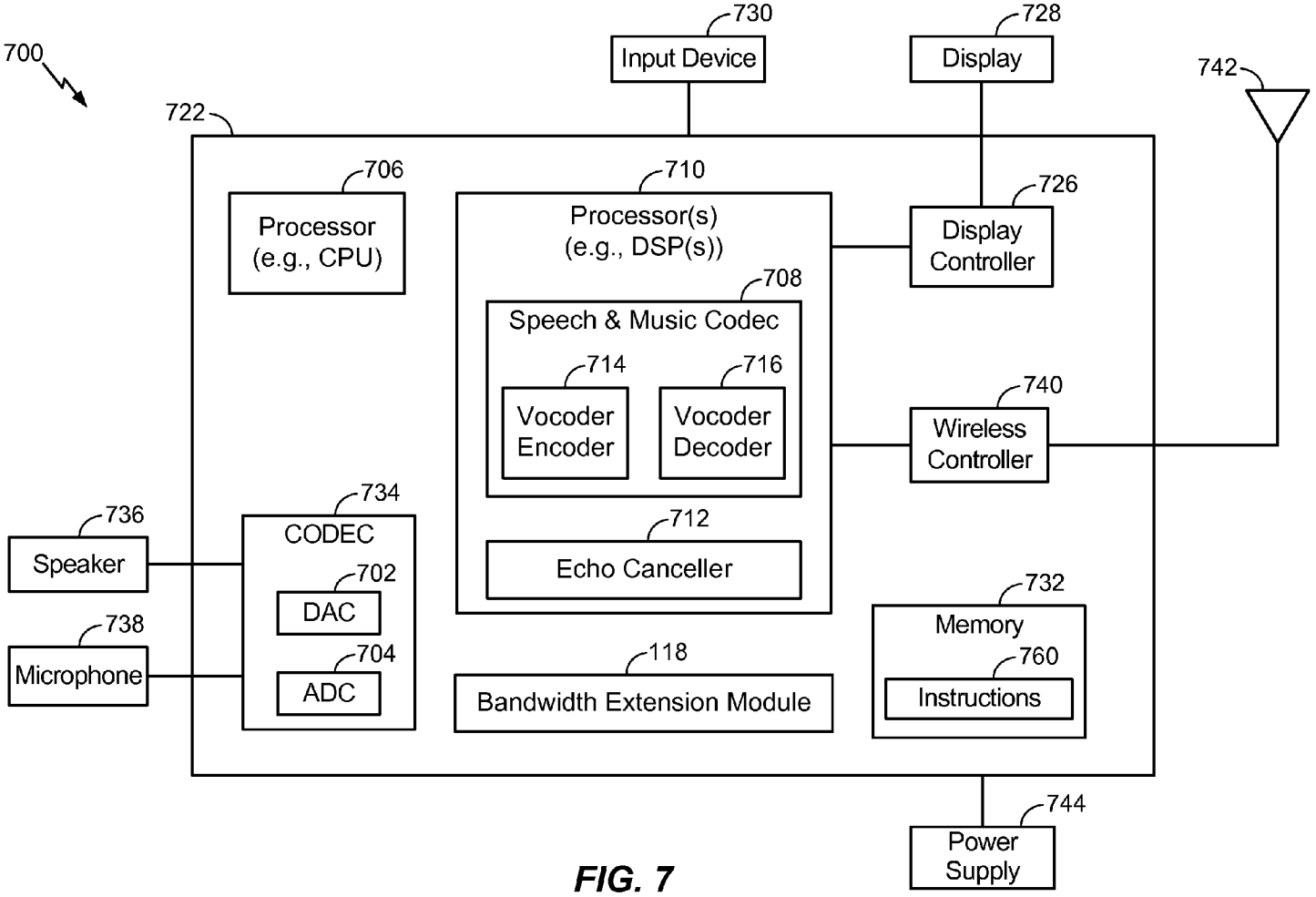
FIG. 7 is a block diagram of a device operable to perform bandwidth extension mode selection in accordance with the systems and methods of FIGS. 1-6.

Referring to FIG. 7, a block diagram of a particular illustrative embodiment of a device (e.g., a wireless communication device) is depicted and generally designated 700. In various embodiments, the device 700 may have fewer or more components than illustrated in FIG. 7. In an illustrative embodiment, the device 700 may correspond to the first device 104 or the second device 106 of FIG. 1. In an illustrative embodiment, the device 700 may operate according to the method 600 of FIG. 6.

In a particular embodiment, the device 700 includes a processor 706 (e.g., a central processing unit (CPU)). The device 700 may include one or more additional processors 710 (e.g., one or more digital signal processors (DSPs)). The processors 710 may include a speech and music coder-decoder (CODEC) 708 and an echo canceller 712. The speech and music CODEC 708 may include a vocoder encoder 714, a vocoder decoder 716, or both. In a particular embodiment, the vocoder encoder 714 may correspond to the encoder 114 of FIG. 1. In a particular embodiment, the vocoder decoder 716 may correspond to the decoder 116 of FIG. 1.

The device 700 may include a memory 732 and a CODEC 734. The device 700 may include a wireless controller 740 coupled to an antenna 742. The device 700 may include a display 728 coupled to a display controller 726. A speaker 736, a microphone 738, or both may be coupled to the CODEC 734. In a particular embodiment, the speaker 736 may correspond to the speaker 142 of FIG. 1. In a particular embodiment, the microphone 738 may correspond to the microphone 146 of FIG. 1. The CODEC 734 may include a digital-to-analog converter (DAC) 702 and an analog-to-digital converter (ADC) 704.

In a particular embodiment, the CODEC 734 may receive analog signals from the microphone 738, convert the analog signals to digital signals using the analog-to-digital converter 704, and provide the digital signals to the speech and music codec 708. The speech and music codec 708 may process the digital signals. In a particular embodiment, the speech and music codec 708 may provide digital signals to the CODEC 734. The CODEC 734 may convert the digital signals to analog signals using the digital-to-analog converter 702 and may provide the analog signals to the speaker 736.

The device 700 may include the bandwidth extension module 118 of FIG. 1. In a particular embodiment, one or more components of the bandwidth extension module 118 may be included in the processor 706, the processors 710, the speech and music codec 708, the vocoder decoder 716, the CODEC 734, or a combination thereof.

The memory 732 may include instructions 760 executable by the processor 706, the processors 710, the CODEC 734, one or more other processing units of the device 700, or a combination thereof, to perform methods and processes disclosed herein, such as the method 600 of FIG. 6.

One or more components of the systems 100-500 may be implemented via dedicated hardware (e.g., circuitry), by a processor executing instructions to perform one or more tasks, or a combination thereof. As an example, the memory 732 or one or more components of the speech and music CODEC 708 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 760) that, when executed by a computer (e.g., a processor in the CODEC 734, the processor 706, and/or the processors 710), may cause the computer to perform at least a portion of one of the method 600 of FIG. 6. As an example, the memory 732 or the one or more components of the speech and music CODEC 708 may be a non-transitory computer-readable medium that includes instructions (e.g., the instructions 760) that, when executed by a computer (e.g., a processor in the CODEC 734, the processor 706, and/or the processors 710), cause the computer perform at least a portion of the method 600 of FIG. 6.

In a particular embodiment, the device 700 may be included in a system-in-package or system-on-chip device (e.g., a mobile station modem (MSM)) 722. In a particular embodiment, the processor 706, the processors 710, the display controller 726, the memory 732, the CODEC 734, the bandwidth extension module 118, and the wireless controller 740 are included in a system-in-package or the system-on-chip device 722. In a particular embodiment, an input device 730, such as a touchscreen and/or keypad, and a power supply 744 are coupled to the system-on-chip device 722. Moreover, in a particular embodiment, as illustrated in FIG. 7, the display 728, the input device 730, the speaker 736, the microphone 738, the antenna 742, and the power supply 744 are external to the system-on-chip device 722. However, each of the display 728, the input device 730, the speaker 736, the microphone 738, the antenna 742, and the power supply 744 can be coupled to a component of the system-on-chip device 722, such as an interface or a controller.

The device 700 may include a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a decoder system, or any combination thereof.

In an illustrative embodiment, the processors 710 may be operable to perform all or a portion of the methods or operations described with reference to FIGS. 1-6. For example, the microphone 738 may capture an audio signal (e.g., the audio signal 130 of FIG. 1). The ADC 704 may convert the captured audio signal from an analog waveform into a digital waveform comprised of digital audio samples. The processors 710 may process the digital audio samples. A gain adjuster may adjust the digital audio samples. The echo canceller 712 may reduce echo that may have been created by an output of the speaker 736 entering the microphone 738.

The vocoder encoder 714 may compress digital audio samples corresponding to the processed speech signal and may form a transmit packet (e.g. a representation of the compressed bits of the digital audio samples). For example, the transmit packet may include the watermark data 232 of FIG. 2, as described with reference to FIGS. 1-2. The transmit packet may be stored in the memory 732. A transceiver may modulate some form of the transmit packet (e.g., other information may be appended to the transmit packet) and may transmit the modulated data via the antenna 742.

As a further example, the antenna 742 may receive incoming packets that include a receive packet. The receive packet may be sent by another device via a network. For example, the receive packet may correspond to the input signal 102 of FIG. 1. The vocoder decoder 716 may uncompress the receive packet. The uncompressed receive packet may be referred to as reconstructed audio samples. The echo canceller 712 may remove echo from the reconstructed audio samples.

The processors 710 may extract the first plurality of parameters 220 from the receive packet, may generate the second plurality of parameters 222, may select the first plurality of parameters 220, the second plurality of parameters 222, or no high band parameters, and may generate the output signal 128 based on selected parameters, as described with reference to FIGS. 2-5. A gain adjuster may amplify or suppress the output signal 128. The DAC 702 may convert the output signal 128 from a digital signal to an analog signal and may provide the converted signal to the speaker 736. In a particular embodiment, the speaker 736 may correspond to the speaker 142 of FIG. 1.

In conjunction with the described embodiments, an apparatus is disclosed that includes means for extracting a first plurality of parameters from a received input signal. The input signal may correspond to an encoded audio signal. For example, the means for extracting may include the extractor 206 of FIGS. 2-5, one or more devices configured to extract the first plurality of parameters (e.g., a processor executing instructions at a non-transitory computer readable storage medium), or any combination thereof.

The apparatus also includes means for performing blind bandwidth extension by generating a second plurality of parameters independent of high band information in the input signal. The second plurality of parameters corresponds to a high band portion of the encoded audio signal. The second plurality of parameters is generated based on low band parameter information corresponding to low band parameters in the input signal. The low band parameters are associated with a low band portion of the encoded audio signal. For example, the means for performing may include the predictor 208 of FIGS. 2-5, one or more devices configured to perform blind bandwidth extension by generating the second plurality of parameters (e.g., a processor executing instructions at a non-transitory computer readable storage medium), or any combination thereof.

The apparatus further includes means for selecting a particular mode from multiple high band modes for reproduction of the high band portion of the encoded audio signal, the multiple high band modes including a first mode using the first plurality of parameters and a second mode using the second plurality of parameters. For example, the means for selecting may include the selector 210 of FIGS. 2-5, one or more devices configured to select a particular mode (e.g., a processor executing instructions at a non-transitory computer readable storage medium), or any combination thereof.

The apparatus also includes means for outputting the first plurality of parameters or the second plurality of parameters based on the selected particular mode. For example, the means for outputting may include the switch 212 of FIGS. 2-5, one or more devices configured to output (e.g., a processor executing instructions at a non-transitory computer readable storage medium), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A device comprising:

a decoder including:

an extractor configured to extract a first plurality of parameters from a received input signal, wherein the input signal corresponds to an encoded audio signal;

a predictor configured to perform blind bandwidth extension by generating a second plurality of parameters independent of high band information in the input signal, wherein the second plurality of parameters corresponds to a high band portion of the encoded audio signal, wherein the second plurality of parameters is generated based on low band parameter information corresponding to low band parameters in the input signal, and wherein the low band parameters are associated with a low band portion of the encoded audio signal;

a selector configured to select a particular mode from multiple high band modes for reproduction of the high band portion of the encoded audio signal, the multiple high band modes including a first mode using the first plurality of parameters and a second mode using the second plurality of parameters; and a switch configured to output the first plurality of parameters or the second plurality of parameters based on the selected particular mode.

2. The device of claim 1, wherein the input signal corresponds to an input bit stream and wherein the extractor is configured to extract the first plurality of parameters concurrently with the predictor generating the second plurality of parameters.

3. The device of claim 1, wherein the selector is further configured to receive a control input signal, wherein the particular mode is selected based on the control input signal.

4. The device of claim 1, wherein the extractor is configured to extract the first plurality of parameters embedded within the low band parameter information in the input signal.

5. The device of claim 1, wherein the extractor is configured to detect a watermark in the input signal, the watermark encoding the first plurality of parameters.

6. The device of claim 1, wherein the extractor is further configured to extract error detection data associated with the first plurality of parameters.

7. The device of claim 6, further comprising:

an error detector coupled to the extractor and to the selector, the error detector configured to:

receive the error detection data; and generate an error output based on the error detection data, wherein the selector is configured to select the particular mode at least partially based on the error output.

8. The device of claim 7, further comprising:

a parameter validity checker configured to generate validity data indicating reliability of the first plurality of parameters, wherein the validity data is based at least in part on the first plurality of parameters and the second plurality of parameters, and wherein the selector is configured to select the particular mode based on the validity data.

9. The device of claim 8, wherein the selector is configured to select the first mode using the first plurality of parameters in response to determining that the validity data satisfies a reliability threshold and that the error output indicates that an error is not detected.

10. The device of claim 9, wherein the selector is further configured to select the second mode using the second plurality of parameters in response to determining that the validity data does not satisfy a reliability threshold or that the error output indicates that the error is detected.

11. The device of claim 9, wherein the selector is further configured to select a third mode of the multiple high band modes in response to determining that the validity data does not satisfy a reliability threshold or that the error output indicates that the error is detected and wherein the switch is configured to output no high band parameters in response to determining that the third mode is selected.

12. The device of claim 1, wherein the decoder is an enhanced adaptive multi-rate (eAMR) decoder.

13. The device of claim 1, wherein the predictor comprises:

a blind bandwidth extender configured to perform the blind bandwidth extension to generate the second plurality of parameters based on analysis data; and a tuner configured to modify the analysis data based at least in part on the first plurality of parameters.

14. The device of claim 1, wherein the first plurality of parameters includes at least one of line spectral frequencies (LSF), gain shape, or gain frame.

15. The device of claim 1, wherein the predictor is configured to generate the second plurality of parameters based on a predicted gain frame.

16. The device of claim 15, wherein the predictor is further configured to adjust the predicted gain frame based on a ratio of a first gain frame of the first plurality of parameters and a second gain frame of the second plurality of parameters.

17. The device of claim 1, wherein the predictor is configured to generate the second plurality of parameters based on average line spectral frequencies (LSF).

18. The device of claim 17, wherein the predictor is further configured to adjust the average LSF based on a first LSF of the first plurality of parameters.

19. The device of claim 1, further comprising an output generator configured to:

generate an output low band portion based on the low band parameters;

generate an output high band portion based on the particular mode; and generate an output signal by combining the output low band portion and the output high band portion.

20. A method comprising:

extracting, at a decoder, a first plurality of parameters from a received input signal, wherein the input signal corresponds to an encoded audio signal;

performing, at the decoder, blind bandwidth extension by generating a second plurality of parameters independent of high band information in the input signal, wherein the second plurality of parameters corresponds to a high band portion of the encoded audio signal, wherein the second plurality of parameters is generated based on low band parameter information corresponding to low band parameters in the input signal, and wherein the low band parameters are associated with a low band portion of the encoded audio signal;

selecting, at the decoder, a particular mode from multiple high band modes for reproduction of the high band portion of the encoded audio signal, the multiple high band modes including a first mode using the first plurality of parameters and a second mode using the second plurality of parameters; and sending the first plurality of parameters or the second plurality of parameters to an output generator of the decoder in response to selection of the particular mode.

21. The method of claim 20, wherein the second plurality of parameters is selected in response to detecting an error associated with the first plurality of parameters.

22. The method of claim 21, wherein the error is detected in response to determining that a cyclic redundancy check (CRC) associated with the first plurality of parameters indicates invalid data.

23. The method of claim 20, wherein the decoder is an enhanced adaptive multi-rate (eAMR) decoder.

24. A computer-readable storage device storing instructions that, when executed by a processor, cause the processor to perform operations comprising:

extracting a first plurality of parameters from a received input signal, wherein the input signal corresponds to an encoded audio signal;

performing blind bandwidth extension by generating a second plurality of parameters independent of high band information in the input signal, wherein the second plurality of parameters corresponds to a high band portion of the encoded audio signal, wherein the second plurality of parameters is generated based on low band parameter information corresponding to low band parameters in the input signal, and wherein the low band parameters are associated with a low band portion of the encoded audio signal;

selecting a particular mode from multiple high band modes for reproduction of the high band portion of the encoded audio signal, the multiple high band modes including a first mode using the first plurality of parameters and a second mode using the second plurality of parameters; and outputting the first plurality of parameters or the second plurality of parameters based on the selected particular mode.

25. The computer-readable storage device of claim 24, wherein the operations further comprise:

generating an output low band portion based on the low band parameters;

in response to determining that the particular mode is the first mode or the second mode:

generating an output high band portion based on the particular mode; and generating an output signal by combining the output low band portion and the output high band portion; and in response to determining that the particular mode is a third mode of the multiple high band modes:

refraining from generating the output high band portion; and generating the output signal based on the output low band portion.

26. The computer-readable storage device of claim 25, wherein the operations further comprise selecting the third mode in response to determining that an error rate associated with the first plurality of parameters is greater than a threshold error rate.

27. The computer-readable storage device of claim 25, wherein the operations further comprise selecting the third mode in response to determining that a difference between the first plurality of parameters and the second plurality of parameters is greater than a particular threshold value.

28. The computer-readable storage device of claim 24, wherein the processor is integrated into an enhanced adaptive multi-rate (eAMR) decoder.

29. An apparatus comprising:

means for extracting a first plurality of parameters from a received input signal, wherein the input signal corresponds to an encoded audio signal;

means for performing blind bandwidth extension by generating a second plurality of parameters independent of high band information in the input signal, wherein the second plurality of parameters corresponds to a high band portion of the encoded audio signal, wherein the second plurality of parameters is generated based on low band parameter information corresponding to low band parameters in the input signal, and wherein the low band parameters are associated with a low band portion of the encoded audio signal;

means for selecting a particular mode from multiple high band modes for reproduction of the high band portion of the encoded audio signal, the multiple high band modes including a first mode using the first plurality of parameters and a second mode using the second plurality of parameters; and means for outputting the first plurality of parameters or the second plurality of parameters based on the selected particular mode.

30. The apparatus of claim 29, further comprising a decoder, a set top box, a music player, a video player, an entertainment unit, a navigation device, a communications device, a personal digital assistant (PDA), a fixed location data unit, a computer, or a combination thereof into which the means for extracting, the means for performing, the means for selecting, and the means for outputting are integrated.

* * * * *